US006383321B2

(12) United States Patent
Kubert et al.

(10) Patent No.: US 6,383,321 B2
(45) **Date of Patent: *May 7, 2002**

(54) APPARATUS AND METHOD FOR APPLYING LABELS TO MAIL

(75) Inventors: Vince Kubert; Christopher A. Struthers, both of Melbourne, FL (US)

(73) Assignee: Profold, Inc., Sebastian, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/312,437

(22) Filed: May 14, 1999

(51) Int. Cl.[7] ..... B65C 1/00; B65C 1/02

(52) U.S. Cl. ..... 156/64; 156/351; 156/363; 156/541; 156/542

(58) Field of Search ..... 156/540, 541, 156/542, 441.5, 442, 442.2, 442.4, 247, 64, 351, 358, 360, 362, 363; 271/110, 265.02, 265.04, 10.02

(56) References Cited

U.S. PATENT DOCUMENTS 3,186,890 A * 6/1965 Dorn et al. ..... 156/354
3,405,021 A * 10/1968 Marano ..... 156/361
4,082,595 A * 4/1978 Slater ..... 156/351
4,294,644 A * 10/1981 Anderson ..... 156/361
4,488,925 A * 12/1984 Craig et al. ..... 156/351
4,869,775 A * 9/1989 Quittner ..... 156/542
5,503,702 A * 4/1996 Filicicchia et al. ..... 156/249
5,683,545 A * 11/1997 Goodwin et al. ..... 156/577
5,776,285 A * 7/1998 Blumle ..... 156/256
5,888,343 A * 3/1999 Olson ..... 156/556
5,891,300 A 4/1999 Oussani, Jr. et al. ..... 156/541
6,230,778 B1 * 5/2001 Latwesen ..... 156/483

* cited by examiner

*Primary Examiner*—Curtis Mayes
*Assistant Examiner*—Sue A. Purvis
(74) *Attorney, Agent, or Firm*—Allen, Dyer, Doppelt, Milbrath & Gilchrist, P.A.

(57) ABSTRACT

An apparatus and method are disclosed for applying labels to mail, including mixed mail. A conveyor conveys individual mail pieces along a predetermined path of travel into a label applying position. The label feed mechanism feeds a web of labels into the label applying position. A label stripper is positioned adjacent the label feed mechanism at the label applying position and adjacent the path of travel to strip labels from the web when an individual mail piece has entered a label applying position. A label roller is positioned adjacent the label stripper. A roller drive mechanism is operatively connected to the label roller for vertically moving the label roller against the label. A connector is operatively connected to the roller drive mechanism for timing the roller drive mechanism to move the label roller against the label as the label is stripped from the web and against an individual mail piece fed under the label stripper.

3 Claims, 3 Drawing Sheets

APPARATUS AND METHOD FOR APPLYING LABELS TO MAIL

FIELD OF THE INVENTION

This invention relates to the field of labeling, and more particularly, this invention relates to the field of labeling mail.

BACKGROUND OF THE INVENTION

In current post office operations, labels often are placed on the mail, and typically the labels are placed on mixed mail of different sizes and thickness. A bar code is then placed on the label. Often, the leading edge is different among the different pieces of mail that are conveyed and handled. Labels are individually positioned on a web and have a self-adhesive placed on the back of the label. The web of labels is pulled around a small roller and then peeled away from the roller, which is contained within a label housing. A piece of mail is passing adjacent to the label housing and the label then is placed on the piece of mail after it is peeled away from the label housing. Typically, the adhesive is of a quality to allow the label to be readily peeled off from the piece of mail without destroying the mail.

However, greater control is required over this type of labeling application because the label often is not adequately applied to an individual mail piece passing under the label housing.

SUMMARY OF THE INVENTION

It is therefore an object of the present invention to provide an apparatus and method for applying labels to mail that allows adequate control over label application where labels are applied from a web of labels adjacent individual mail pieces conveyed along a predetermined path of travel.

In accordance with the present invention, the apparatus applies labels to mail, including mixed mail, and includes a conveyor for conveying individual mail pieces along a predetermined path of travel at a predetermined speed into a label applying position. A label feed mechanism feeds a web of labels into the label applying position. A label stripper is positioned adjacent the label feed mechanism at the label applying position and adjacent the path of travel to strip labels from the web when an individual mail piece has entered a label applying position. The label roller is positioned adjacent the label stripper. A roller drive mechanism is operatively connected to the label roller and vertically moves the label roller against the label. A controller is operatively connected to the roller drive mechanism and times the roller drive mechanism and moves the label roller against the label as the label is stripped from the web and against an individual mail piece fed under the label stripper.

In another aspect of the present invention, the roller drive mechanism includes a label frame that supports the label roller. A roller bushing is mounted on the label frame and moveable therewith. A fixed rotary solenoid has an arm actuator that engages the roller bushing for pressing down upon the roller bushing and moving down the label frame and attached label roller. The label stripper includes a label stripping roller positioned at the label applying position over which the web of labels is applied. The diameter of the label stripping roller is such that a label is stripped or peeled from the web of labels as the web of labels moves over the label stripping roller.

The label stripper further includes a label drawing mechanism for drawing the web of labels around the label stripping roller. The label drawing mechanism includes a servomechanism operatively connected to the controller for pulling the web of labels over the label stripping roller a predetermined distance at a predetermined time when an individual mail piece is aligned at a predetermined position under the label stripper. The label is applied onto a predetermined position of the individual mail piece. A mail sensor is positioned along the predetermined path of travel and operatively connected to the controller for sensing the leading edge of an individual mail piece. An encoder is operatively connected to the conveyor and controller for determining the conveyor speed and distance an individual mail piece has traveled. An edge guide maintains in registration with the path of travel each individual mail piece. Pressure rollers can be used for engaging mail pieces as the mail pieces move into the label applying position.

In still another aspect of the present invention, a label housing has front and rear sections and is mounted above the predetermined path of travel at the label applying position. The web of labels is fed through the label housing and into the label applying position. A label stripping roller is mounted within the front section of the label housing and positioned adjacent the predetermined path of travel over which the web of labels is received. The label frame is mounted for vertical movement on the front of the label housing and the label roller is rotatably mounted on the label frame. The roller drive mechanism is mounted on the label housing and selectively engages the label frame and moves downward the label frame and label roller mounted thereon. A controller is operatively connected to the roller drive mechanism for timing the roller drive mechanism while moving the label roller against the label as it is stripped from the web such that the label is pressed against the individual piece of mail.

In a method aspect of the present invention, labels are applied to mail. The method comprises the steps of conveying individual mail pieces along a predetermined path of travel at a predetermined speed into a label applying position. The method also comprises the step of feeding a label position on a web of labels into the label applying position and stripping the label from the web of labels. While the label is being stripped from the web of labels, moving a label roller against a label and pressing with the label roller the stripped portion of the label against the mail piece that is moving underneath.

In still another aspect of the present invention, the method comprises the step of mounting the label roller and a roller bushing on a label frame and biasing an actuator arm against the roller bushing for pressing the label roller down against the label to press the label onto the mail piece fed under the label stripper. The method can also strip a label from the web of labels by passing the web of labels over a label stripping roll that has a diameter to allow stripping of the labels therefrom. The label is pulled over the label stripping roll a predetermined amount and a predetermined distance when an individual mail piece is aligned at a predetermined position under the label stripper while applying the label onto a predetermined position of the individual mail piece.

The method also comprises the step of sensing the leading edge of an individual mail piece and moving the mail piece a predetermined distance based on the sensed edge of the mail piece. The method also comprises the step of determining the conveyor speed and distance an individual mail piece travels along the predetermined path of travel through an encoder.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

Figure 1:
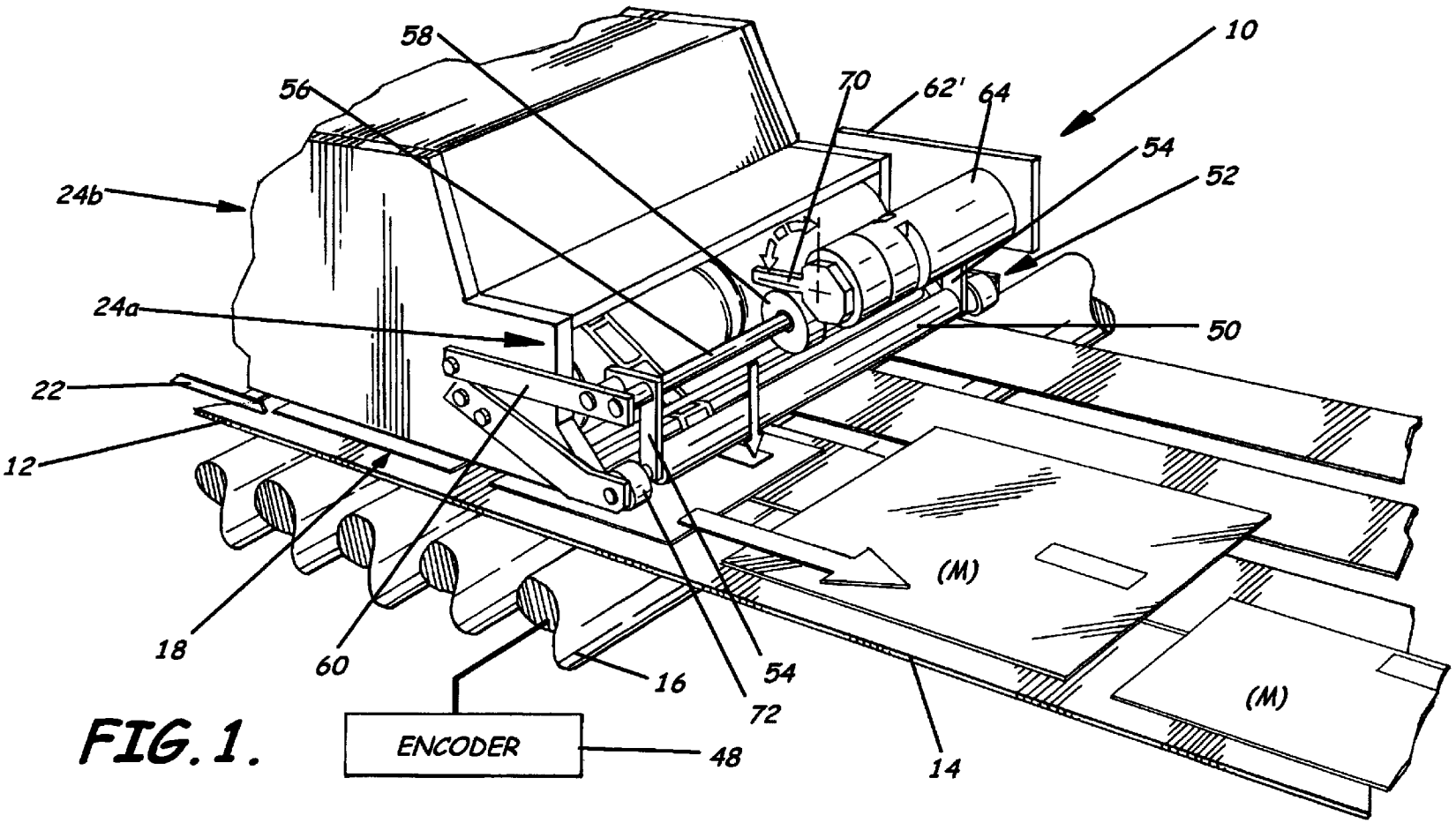
FIG. 1 is an isometric view of the apparatus for applying labels in accordance with the present invention showing a label feed mechanism, label stripper and conveyor.

Referring now to FIG. 1, there is illustrated the apparatus 10 of the present invention that applies labels to mail, including mixed mail pieces (M) that have different sizes, including different lengths and widths of the mail and different thicknesses. As evident, the apparatus includes a conveyor 12, which in the illustrated embodiment is configured as a series of longitudinally extending endless conveyor belts 14. A series of transverse extending rollers 16 are positioned under one portion of the conveyor 12 and define a label applying position 18 as illustrated. Although only one portion of the conveyor is shown, those skilled in the art understand that this type of mail handling system includes different mail handling stations positioned along the conveyor system, including stations for feeding and tabbing mixed pieces of mail, a vacuum table, feed bins, and storage bins. The present description will extend only to the particular aspect of applying labels onto the mixed mail in accordance with the present invention.

The labels are typically blank. Naturally, the invention could be used for applying labels to many different types of flat products, such as mail. However, the description will proceed only with the use of the apparatus and method for applying labels onto individual mail pieces (M) that are formed as flat, mixed mail. The labels typically have an adhesive that allows the label to stick to an individual mail piece and then be peeled away from the mail piece without damaging the mail.

The conveyor operates usually at a predetermined speed up to about 6.2 feet per second in one embodiment. The mail usually will be registered straight against the side such that one side of an individual mail piece (M) is aligned with the side of another individual mail piece as illustrated in FIG. 1. An edge guide 22 could be used for maintaining in registration each individual mail piece.

Figures 2, 3:
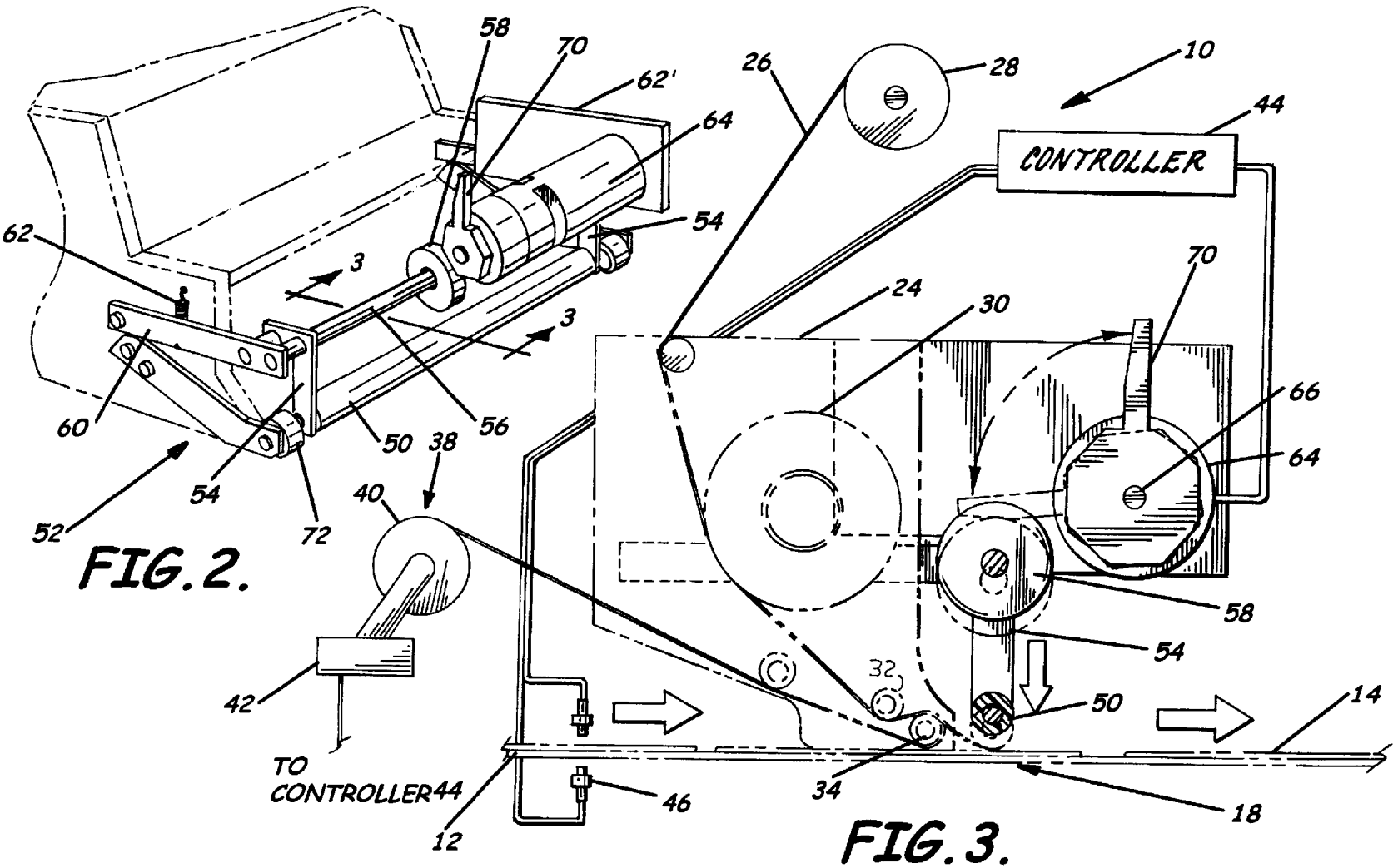
FIG. 2 is another perspective view of the label frame, label roller and roller drive mechanism mounted on a label housing.
FIG. 3 is a sectional view taken along line 3—3 of FIG. 2 showing some internal components in the label housing.

At the label applying position 18, a label housing 24 is positioned. As shown in FIG. 3, the label housing 24 has front and rear sections 24*a*, 24*b* and is mounted above the predetermined path of travel at the label applying position 18. A web of labels 26 is fed into the label applying position 18 from a supply roll 28 that is mounted separate from the label housing 24. The web of labels 26 is fed from the supply roll 28. The web of labels 26 includes spaced labels that are positioned on the underlying web. The web of labels 26 is fed from the supply roll 28 into the label housing 24 and around a larger guide roll 30, under a first pinion roll 32, and over a label stripping roll 34 mounted within the front section of the label housing and positioned adjacent the predetermined path of travel defined by the conveyor 12.

The diameter of the label stripping roller 34 is such that the roll bends the web sufficiently to allow the peeling of labels from the underlying web as the web of labels passes over the label stripping roller. Because the labels are applied by a self-adhesive onto the underlying web, the web of labels is pulled in acceleration followed by a deceleration, at a timed moment.

The particular label that is positioned on the web will be pulled around the label stripping roller 34 and be peeled from the web. A label drawing mechanism 38 is used for drawing the web of labels around the label stripping roller 34. Typically, the label drawing mechanism includes a take-up roll 40 and a servomechanism 42, such as a servomotor operatively connected to a controller 44 and the take-up roll 40. The controller 44 is also connected to sensors 46 (FIG. 3) that sense the leading edge of an individual piece of mail as it advances along the conveyor. One of the transverse extending rolls 16 can have an encoder 48 that determines the speed of the conveyor. The encoder 48 is operatively connected to the controller 44. Thus, based on the sensed leading edge of an individual mail piece (M), the servomotor 42 pulls the web of labels over the label stripping roller 34 a predetermined distance at a predetermined time when an individual mail piece is aligned at a predetermined position under the label stripper. As the label is peeled from the web, it is placed onto the individual mail piece at a predetermined location on the mail piece. Such operation can be varied by allowing the web of labels to be drawn and pulled at a selected period of time when the individual mail piece is located at a specific location under the front section 24*a* of the label housing 24. Thus, a label can be applied at any predetermined location on the individual mail piece.

To ensure adequate labeling and ensure that the label is applied onto the mail in an efficient manner, a label roller 50 presses against the label while the label is being stripped from the web of labels to push the label against the mail.

As illustrated in FIGS. 2 and 3, a label frame 52 is mounted for vertical movement on the front section of the label housing 24. The label roller 50 is rotatably mounted on the label frame 52. The label frame 52 includes two opposing parallel support brackets 54 that support the label roller 50. The upper portion of the support bracket 54 includes a transversely extending support rod 56 having a roller bushing 58 mounted thereon. The support brackets 54 are connected to support arms 60 that are pivotally mounted to the front portion of the label housing 24 as illustrated in FIG. 2. A spring 62 is connected between the label housing 24 and the support arms 60 to bias the roller 50 upward away from the predetermined path of travel and bias upward the label frame and thus the label roller.

A support plate 62 is mounted on the label housing 24 and includes a rotary solenoid 64 having an output shaft 66 with an actuator arm 20 mounted on the output shaft. The rotary solenoid 64 is connected to the controller 44 (FIG. 3).

At a predetermined time, based on when a label is drawn around the label stripping roller, the controller 44 actuates the rotary solenoid 64 to move the actuator arm 70 against the roller bushing 58 and press downward such that the label frame is moved vertically down and the label roller is pushed against the label as it is stripped from the web of labels. Thus, the label roller presses the stripped portion of the label against a mail piece that is moving underneath. A pressure roller 72 is positioned on either side and maintains pressure against the mail to keep it flat.

Figure 4:
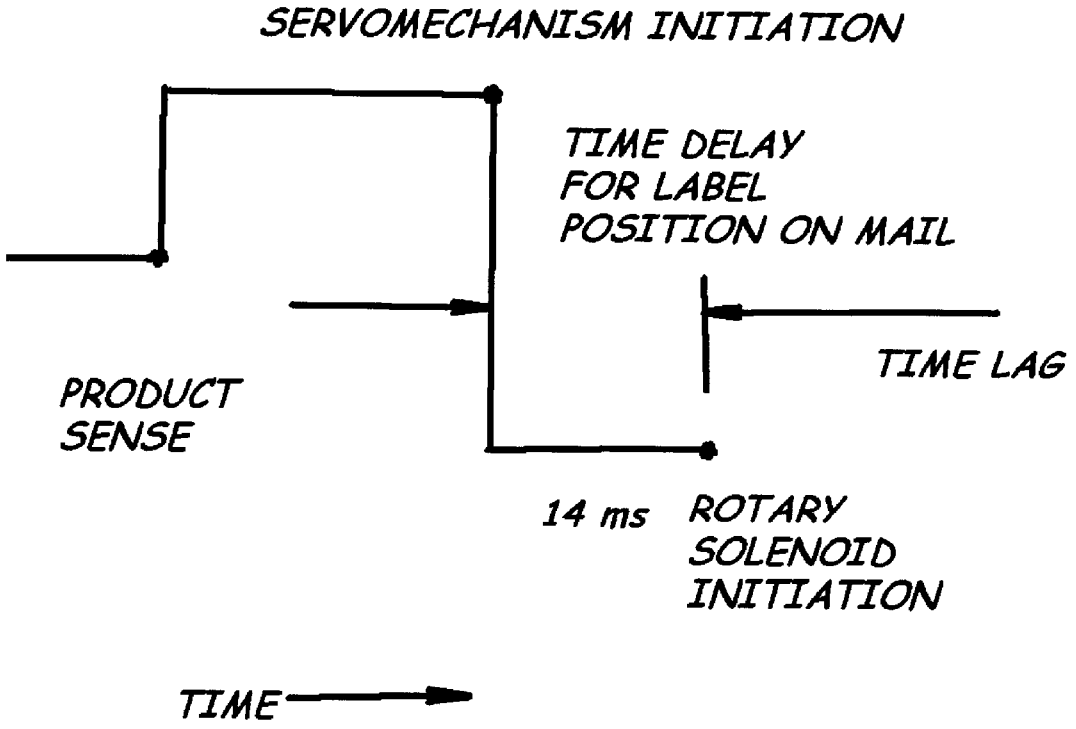
FIG. 4 is a graph showing one timing sequence for the apparatus and method of the present invention.

In operation, the individual mail pieces (M) are fed along the conveyor 12 where the leading edge is sensed. When the individual mail piece has traveled a predetermined distance based upon the calculated speed of the conveyor and the sensed leading edge, the servomotor 42 is actuated to pull the web of labels such that an individual label is transferred off from the web. The controller 44 then actuates the rotary solenoid to move the actuator arm against the roller bushing and thus move the label frame downward to press the label roller against the label as it is peeled from the web. The label is thus applied to the individual mail piece at the predetermined location. FIG. 4 illustrates one example of the timing that can be used. A 14 ms delay can exist to position the label on the mail.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A method for applying labels to mixed mail pieces comprising:

conveying individual mixed mail pieces having different lengths, widths and thicknesses along a predetermined path of travel at a predetermined speed into a label applying position;

sensing the leading edge of an individual mixed mail piece and moving the mixed mail piece a predetermined distance based on the sensed leading edge, and the speed and distance as determined by an encoder;

feeding a label positioned on a web of labels into the label applying position;

stripping the label from the web of labels;

while the label is being stripped from the web of labels, moving a label roller against the label and pressing with the label roller the stripped portion of the label against the mixed mail piece that is moving underneath;

wherein the step of stripping a label from the web of labels further comprises the step of passing the web of labels over a label stripping roll that has a diameter to allow stripping of the labels therefrom;

pulling the label over the label stripping roll a predetermined amount and a predetermined distance when an individual mixed mail piece is aligned at a predetermined position under the label stripper for applying the label onto a predetermined position of the individual mixed mail piece, wherein the web of labels is pulled in acceleration followed by a deceleration at a predetermined time of the same label application to assist stripping of labels from an underlying web; and varying the pulling of the web of labels at a selected period of time for a different mixed mail piece when a different mixed mail piece is located at a specific location at the label applying position to accommodate individual mixed mail pieces having different lengths, widths and thicknesses.

2. A method according to claim 1, and further comprising the steps of mounting the label roller and a roller bushing on a label frame and biasing an actuator arm against the roller bushing for pressing the label roller down against the label to press the label onto the mail piece fed under the label stripper.

3. A method according to claim 1, and further comprising the step of determining the conveyor speed and distance an individual mail piece travels along the predetermined path of travel through an encoder.

* * * * *